US009432784B2

(12) United States Patent
Wu et al.

(10) Patent No.: US 9,432,784 B2
(45) Date of Patent: Aug. 30, 2016

(54) METHOD AND APPARATUS FOR ESTIMATING INTERCHANNEL DELAY OF SOUND SIGNAL

(71) Applicants: Wenhai Wu, Beijing (CN); Lei Miao, Beijing (CN); Yue Lang, Munich (DE); Zexin Liu, Beijing (CN)

(72) Inventors: Wenhai Wu, Beijing (CN); Lei Miao, Beijing (CN); Yue Lang, Munich (DE); Zexin Liu, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 286 days.

(21) Appl. No.: 13/730,724

(22) Filed: Dec. 28, 2012

(65) Prior Publication Data

US 2013/0114817 A1 May 9, 2013

Related U.S. Application Data

(63) Continuation of application No. PCT/CN2011/074991, filed on May 31, 2011.

(30) Foreign Application Priority Data

Jun. 30, 2010 (CN) ..... 2010 1 0222476

(51) Int. Cl.

| | |
|---|---|
| ***H04R 1/32*** | (2006.01) |
| ***H04R 29/00*** | (2006.01) |
| ***G10L 19/008*** | (2013.01) |

(52) U.S. Cl.

CPC ..... *H04R 29/00* (2013.01); *G10L 19/008* (2013.01); *H04S 2420/03* (2013.01)

(58) Field of Classification Search

None

See application file for complete search history.

(56) References Cited

U.S. PATENT DOCUMENTS

| | | | | |
|---|---|---|---|---|
| 6,026,169 | A | 2/2000 | Fujimori | |
| 7,492,217 | B2 * | 2/2009 | Hansen et al. | 330/10 |
| 8,085,958 | B1 * | 12/2011 | Trautmann et al. | 381/310 |
| 8,223,976 | B2 * | 7/2012 | Purnhagen et al. | 381/23 |
| 2007/0223750 | A1 * | 9/2007 | Bai et al. | 381/309 |

(Continued)

FOREIGN PATENT DOCUMENTS

| | | | |
|---|---|---|---|
| CN | 1843059 | A | 10/2006 |
| CN | 101162922 | A | 4/2008 |

(Continued)

OTHER PUBLICATIONS

International Search Report dated Aug. 25, 2011 in connection with International Patent Application No. PCT/CN2010/074991, 6 pages.

(Continued)

*Primary Examiner* — Curtis Kuntz
*Assistant Examiner* — Qin Zhu

(57) ABSTRACT

A method and an apparatus for estimating an interchannel delay of a sound signal are, related to the communication field and capable of realizing a stable sound field in a crosstalk. The method includes calculating an error between an actual interchannel phase difference and a predicted interchannel phase difference of a sound signal. The predicted interchannel phase difference is predicted according to a predetermined interchannel delay of the sound signal. The method also includes determining whether the sound signal is a sound signal in a crosstalk according to the error. The method further includes, if the sound signal is a sound signal in the crosstalk, setting an interchannel delay corresponding to the sound signal to a fixed value. The apparatus is configured to perform the method.

17 Claims, 10 Drawing Sheets

(56) References Cited

U.S. PATENT DOCUMENTS

| | | | | |
|---|---|---|---|---|
| 2008/0002842 | A1* | 1/2008 | Neusinger et al. | 381/119 |
| 2008/0170711 | A1* | 7/2008 | Breebaart et al. | 381/77 |
| 2009/0222272 | A1* | 9/2009 | Seefeldt et al. | 704/500 |
| 2011/0026730 | A1* | 2/2011 | Li et al. | 381/92 |
| 2011/0096932 | A1* | 4/2011 | Schuijers | 381/22 |
| 2011/0123031 | A1* | 5/2011 | Ojala | 381/17 |
| 2014/0270281 | A1* | 9/2014 | Walsh et al. | 381/300 |

FOREIGN PATENT DOCUMENTS

| | | | |
|---|---|---|---|
| CN | 101533641 | A | 9/2009 |
| JP | 3-111000 | A | 5/1991 |
| JP | 2000-295111 | A | 10/2000 |

OTHER PUBLICATIONS

International Search Report dated Aug. 25, 2011 in connection with International Patent Application No. PCT/CN2011/074991.

Written Opinion of the International Searching Authority dated Aug. 25, 2011 in connection with International Patent Application No. PCT/CN2011/074991.

Stuart N. Wrigley, et al., "Speech and Crosstalk Detection in Multi-Channel Audio", IEEE Transactions on Speech and Audio Processing, vol. X, No. Y, Sep. 2004, 8 pages.

* cited by examiner

METHOD AND APPARATUS FOR ESTIMATING INTERCHANNEL DELAY OF SOUND SIGNAL

CROSS-REFERENCE TO RELATED APPLICATIONS

This application is a continuation of International Application No. PCT/CN2011/074991, filed on May 31, 2011, which claims priority to Chinese Patent Application No. 201010222476.1, filed on Jun. 30, 2010, both of which are hereby incorporated by reference in their entireties.

TECHNICAL FIELD

The present invention relates to the communication field, and in particular, to a method and an apparatus for estimating an interchannel delay of a sound signal.

BACKGROUND

In stereophonic encoding, left and right channel signals are not encoded directly; instead, left and right channel signals are downmixed firstly and the downmixed signals are encoded. Then, some additional sideband information is encoded. Stereophonic signals are restored at the decoding end by using the downmixed signals and the sideband information. In general, there is a distance variation or distance difference between a sound generator and two microphones recording the left channel and the right channel. Therefore, the left channel signal is not completely synchronous with the right channel signal, that is, there is a certain delay between the left channel signal and the right channel signal. It is necessary to estimate the delay correctly and restore the delay at the decoding end to guarantee the sound intensity of a synthesized signal.

Currently, when an interchannel delay is estimated, a weighted cross-correlation function between the left channel and the right channel is calculated; a delay corresponding to a maximum value of the weighted cross-correlation function is found and used as the delay between the left channel and the right channel. For a single sound generator, because it has a single left channel and a single right channel and the locations of the left channel and right channel are fixed relative to the two microphones recording the left channel and the right channel, a relatively accurate interchannel delay may be estimated by using the above method.

For multiple sound generators, that is, a crosstalk, because there are multiple left channels and multiple right channels, the sound field swings in the left direction or in the right direction from time to time, and the right sound field swings to the left while the left channel swings to the right. As a result, it is difficult to determine which left channel and right channel are produced from a same sound generator. If the interchannel delay in the crosstalk is estimated by using the above method, the estimated inter-channel delay is inaccurate, which causes an unstable estimated sound field.

SUMMARY

Embodiments of the present invention provide a method and an apparatus for estimating an interchannel delay of a sound signal, so that a stable sound field can be realized in a crosstalk.

An embodiment of the present invention provides a method for estimating an interchannel delay of a sound signal, including: calculating an error between an actual interchannel phase difference and a predicted of a sound signal, where the predicted interchannel phase difference is predicted according to a predetermined interchannel delay of the sound signal; determining whether the sound signal is a sound signal in a crosstalk according to the error; and if the sound signal is a sound signal in the crosstalk, setting an interchannel delay corresponding to the sound signal to a fixed value.

An embodiment of the present invention provides an apparatus for estimating an interchannel delay of a sound signal, including: a calculating unit, configured to calculate an error between an actual interchannel phase difference and a predicted interchannel phase difference of a sound signal, where the predicted interchannel phase difference is predicted according to a predetermined interchannel delay of the sound signal; a first determining unit, configured to determine whether the sound signal is a sound signal in a crosstalk according to the error calculated by the calculating unit; and a processing unit, configured to: when the first determining unit determines that the sound signal is a sound signal in the crosstalk, set an interchannel delay corresponding to the sound signal to a fixed value.

According to the technical solutions provided by the embodiments of the present invention, whether a sound signal is a sound signal in a crosstalk is detected; when the sound signal is detected to be a sound signal in the crosstalk, an interchannel delay corresponding to the sound signal is set to a fixed value. Compared with the prior art in which a uniform method for estimating an interchannel delay is used without detecting whether the sound signal is a sound signal in a crosstalk, while, in the technical solutions of the present invention, the interchannel delay corresponding to the sound signal which is detected to be a sound signal in the crosstalk is set to be a fixed value, so as to avoid wrong estimation of the interchannel delay causing the instability of a sound field, thereby realizing a stable sound field in the crosstalk.

BRIEF DESCRIPTION

To describe the technical solutions in the embodiments of the present invention or in the prior art more clearly, the following briefly describes the accompanying drawings required for describing the embodiments or the prior art. Apparently, the accompanying drawings in the following descriptions show merely some embodiments of the present invention, and persons of ordinary skill in the art may still derive other drawings from the accompanying drawings without creative efforts.

DETAILED DESCRIPTION

The following clearly describes the technical solutions in the embodiments of the present invention with reference to the accompanying drawings in the embodiments of the present invention. Apparently, the described embodiments are merely a part rather than all of the embodiments of the present invention. All other embodiments obtained by persons of ordinary skill in the art based on the embodiments of the present invention without creative efforts shall fall within the protection scope of the present invention.

Embodiment 1

Figure 1:
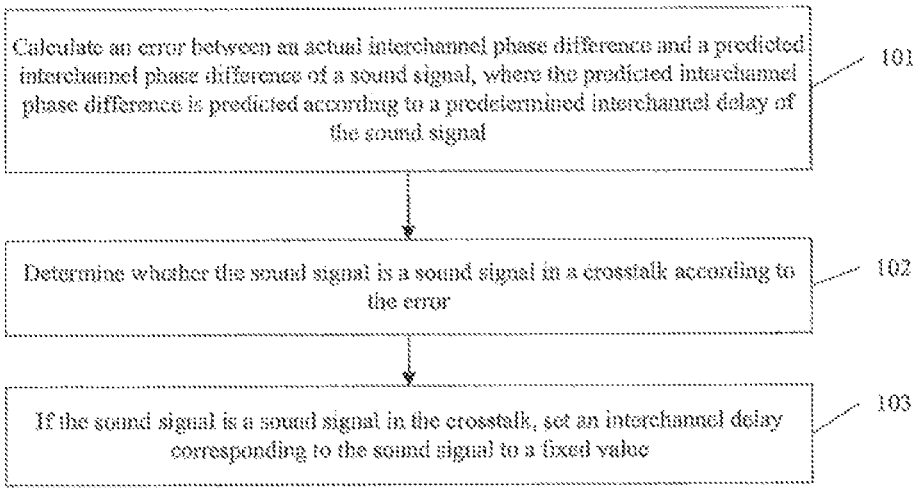
FIG. 1 is a flowchart of a method for estimating an interchannel delay of a sound signal according to a first embodiment of the present invention.

The embodiment of the present invention provides a method for estimating an interchannel delay of a sound signal. As shown in FIG. 1, the method includes the following:

101. Calculate an error between an actual interchannel phase difference and a predicted interchannel phase difference of a sound signal, where the predicted interchannel phase difference is predicted according to a predetermined interchannel delay of the sound signal.

The predetermined interchannel delay includes at least one of an estimated interchannel delay and a fixed interchannel delay, where the estimated interchannel delay is a delay estimated by using an interchannel correlation. The error may be obtained by calculating an actual interchannel phase difference of the sound signal and a predicted interchannel phase difference of the sound signal, where the predicted interchannel phase difference of the sound signal is predicted according to at least one of the estimated interchannel delay and the fixed interchannel delay.

The error may be a sum of absolute values of differences between the actual interchannel phase differences and the predicted interchannel phase differences corresponding to frequencies in a frequency band or be a mean value of absolute values of differences between the actual interchannel phase differences and the predicted interchannel phase differences corresponding to frequencies in a frequency band, which is not specifically limited in the embodiment of the present invention. The error may also be a quadratic sum of differences between the actual interchannel phase differences and the predicted interchannel phase differences corresponding to frequencies in a frequency band or be a mean value of squares of differences between the actual interchannel phase differences and the predicted interchannel phase differences corresponding to frequencies in a frequency band.

102. Determine whether the sound signal is a sound signal in a crosstalk according to the error.

103. If the sound signal is a sound signal in the crosstalk, set an interchannel delay corresponding to the sound signal to a fixed value.

The fixed value is an empirical value, and may be set by a user according to the specific implementation, which is not specifically limited in the embodiment of the present invention. For example, the fixed value may be "0". The interchannel delay corresponding to the sound signal is set to a fixed value, to maintain the stability of the sound intensity.

In the embodiment of the present invention, whether a sound signal is a sound signal in a crosstalk is detected; when the sound signal is detected to be a sound signal in the crosstalk, an interchannel delay corresponding to the sound signal is set to a fixed value. Compared with the prior art in which a uniform method for estimating an interchannel delay is used without detecting whether the sound signal is a sound signal in a crosstalk, while, in the embodiment of the present invention, the interchannel delay corresponding to the sound signal which is detected to be a sound signal in the crosstalk is set to be a fixed value, so as to avoid wrong estimation of the interchannel delay causing the instability of a sound field, thereby realizing a stable sound field in the crosstalk.

Embodiment 2

Figure 2:
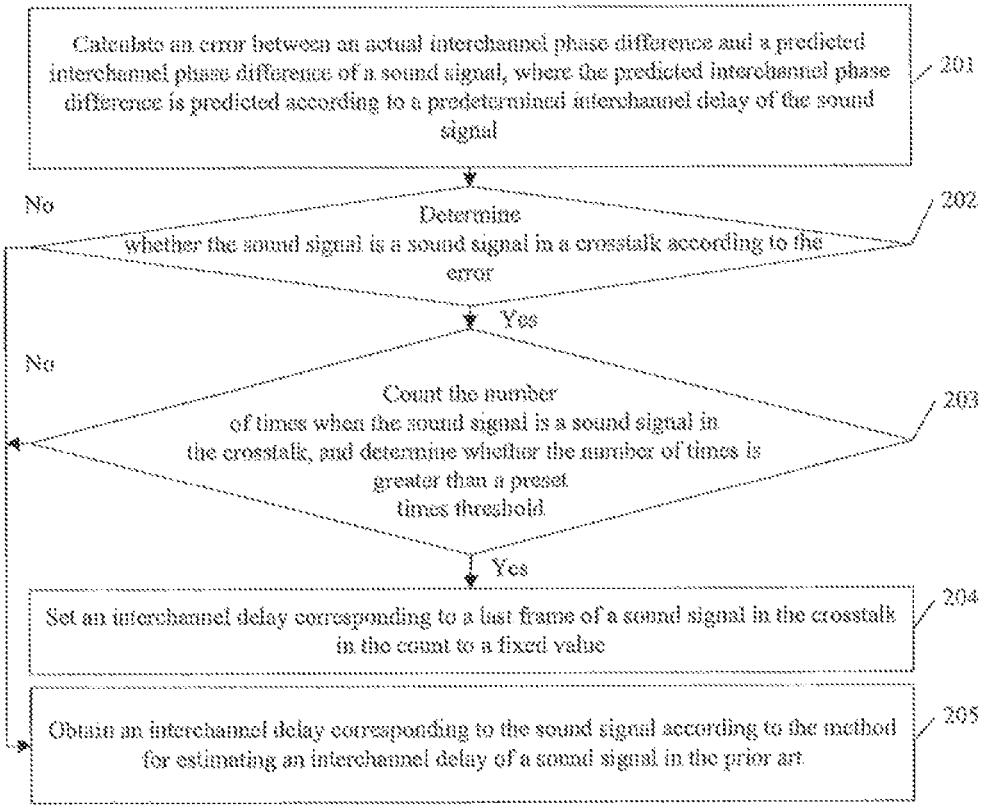
FIG. 2 is a flowchart of a method for estimating an interchannel delay of a sound signal according to a second embodiment of the present invention.

The embodiment of the present invention provides a method for estimating an interchannel delay of a sound signal. To ensure that whether a sound signal is a sound signal in a crosstalk is detected accurately, the number of times when the sound signal is a sound signal in the crosstalk is set; when the number of times is reached, it indicates that the current sound signal is a very stable sound signal in the crosstalk. As shown in FIG. 2, the method includes the following:

201. Calculate an error between an actual interchannel phase difference and a predicted interchannel phase difference of a sound signal, where the predicted interchannel phase difference is predicted according to a predetermined interchannel delay of the sound signal.

The predetermined interchannel delay includes at least one of an estimated interchannel delay and a fixed interchannel delay, where the estimated interchannel delay is a delay estimated by using an interchannel correlation. The error may be obtained by calculating an actual interchannel phase difference of the sound signal and a predicted interchannel phase difference of the sound signal, where the predicted interchannel phase difference of the sound signal is predicted according to at least one of the estimated interchannel delay and the fixed interchannel delay.

The error may be a sum of absolute values of differences between the actual interchannel phase differences and the predicted interchannel phase differences corresponding to frequencies in a frequency band or be a mean value of absolute values of differences between the actual interchannel phase differences and the predicted interchannel phase differences corresponding to frequencies in a frequency band, which is not specifically limited in the embodiment of the present invention. The error may also be a quadratic sum of differences between the actual interchannel phase differences and the predicted interchannel phase differences corresponding to frequencies in a frequency band or be a mean value of squares of differences between the actual interchannel phase differences and the predicted interchannel phase differences corresponding to frequencies in a frequency band.

202. Determine whether the sound signal is a sound signal in the crosstalk according to the error; if the sound signal is a sound signal in the crosstalk, execute step 203; if the sound signal is not a sound signal in the crosstalk, execute step 205.

Further, it should be noted that when the sound signal of a current frame is received and is determined to be a sound signal in the crosstalk, the determining result may be wrong due to the instability of the sound signal during a talk. To determine whether the currently received sound signal is a sound signal in the crosstalk more accurately, a threshold for the number of times when the sound signal is a sound signal in the crosstalk is set; if the number of times when the sound signal is a sound signal in the crosstalk reaches the times threshold, it may be determined that the currently received sound signal is really a sound signal in the crosstalk. Therefore, after the sound signal is determined to be a sound signal in the crosstalk according to the error, execute step 203.

203. Count the number of times when the sound signal is a sound signal in the crosstalk, and determine whether the number of times is greater than a preset times threshold; if the number of times is greater than the preset times threshold, it indicates that a current speaking scenario is really a crosstalk and that the received sound signal is really a sound signal in the crosstalk, execute step 204; if the number of times is smaller than or equal to the preset times threshold, it indicates that a current speaking scenario is not a crosstalk and that the received sound signal is not a sound signal in the crosstalk, execute step 205.

The preset times threshold is an empirical value and may be set by a user according to a specific requirement, which is not specifically limited in the embodiment of the present invention. For example, the times threshold may be set to three.

204. Set an interchannel delay corresponding to a last frame of a sound signal in the crosstalk in the count to a fixed value.

The fixed value is an empirical value, and may be set by a user according to specific implementation, which is not specifically limited in the embodiment of the present invention. For example, the fixed value may be set to "0". The interchannel delay corresponding to the last frame of the sound signal in the crosstalk in the count is set to a fixed value to maintain the stability of the sound intensity.

205. Obtain an interchannel delay corresponding to the sound signal according to the method for estimating an interchannel delay of a sound signal in the prior art.

Figure 3:
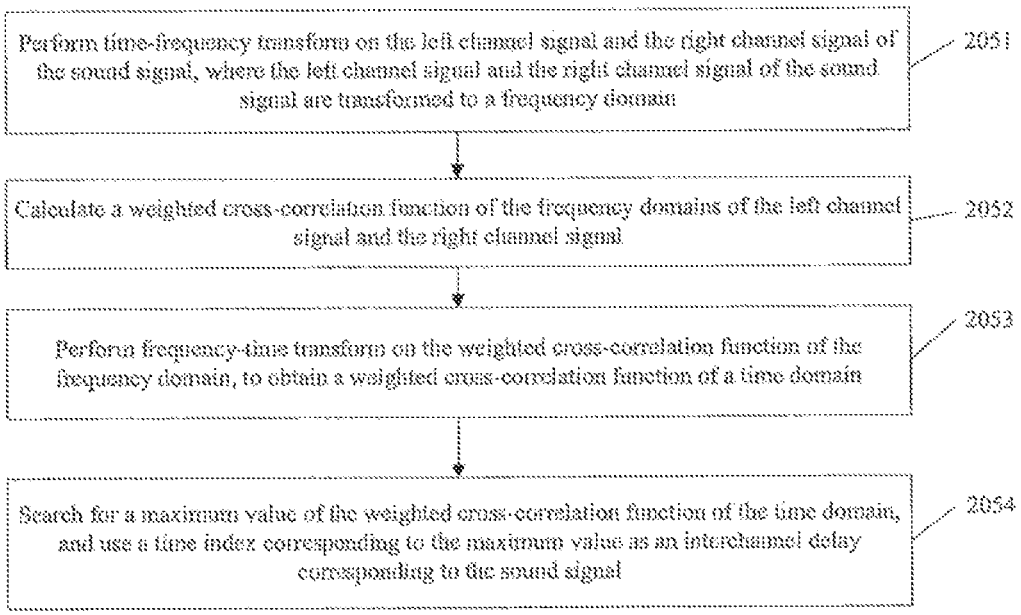
FIG. 3 is a flowchart of a method for estimating an interchannel delay of a sound signal in the prior art.

The method for estimating an interchannel delay of a sound signal in the prior art may be implemented by but is not limited to the following method. A weighted cross-correlation function between a left channel and a right channel is calculated, and a delay corresponding to a maximum value of the weighted cross-correlation function is found and used as the delay between the left channel and the right channel. Specifically, as shown in FIG. 3, the method may include the following:

2051. Perform time-frequency transform on the left channel signal and the right channel signal of the sound signal, where the left channel signal and the right channel signal of the sound signal are transformed to a frequency domain.

2052. Calculate a weighted cross-correlation function of the frequency domains of the left channel signal and the right channel signal.

The weighted cross-correlation function of the frequency domains of the left channel signal and the right channel signal may be calculated in a part of frequency bands or all frequency bands.

When the calculation is performed in all frequency bands, the weighted cross-correlation function $C_r(k)$ may be calculated by using Formula 1. The following is Formula 1:

$$C_r(k) = \begin{cases} W(k)X_1(k)X_2^*(k) & 0 \le k \le N/2 \\ 0 & N/2 < k < N \end{cases} \quad \text{(Formula 1)}$$

When the calculation is performed in a part of frequency bands, the weighted cross-correlation function $C_r(k)$ may be calculated by using Formula 2 below:

$$C_r(k) = \begin{cases} W(k)X_1(k)X_2^*(k) & 0 \le k \le M \\ 0 & M < k < N \end{cases} \quad \text{(Formula 2)}$$

where, W(k) indicates a weighted function, $X_2^*(k)$ indicates a conjugate function of $X_2(k)$, $X_1(k)$ and $X_2(k)$ indicate the time-frequency transform of the left channel signal and the right channel signal, respectively, k indicates a frequency index, and N indicates the length of time-frequency transform.

2053. Perform frequency-time transform on the weighted cross-correlation function of the frequency domain, to obtain a weighted cross-correlation function of a time domain.

The frequency-time transform may adopt any frequency-time transform method in the prior art, for example, FFT (Fast Fourier Transform, fast Fourier transform) transform.

2054. Search for a maximum value of the weighted cross-correlation function of the time domain, and use a time index corresponding to the maximum value as an interchannel delay corresponding to the sound signal.

During the search for the maximum value of the weighted cross-correlation function of the time domain, the maximum value may be found from absolute values of the weighted cross-correlation function, or from the weighted cross-correlation function, which is not specifically limited in the embodiment of the present invention.

For example, when the maximum value is found from the absolute values of the weighted cross-correlation function, the maximum value $d_g$ may be calculated by using Formula 3 below:

$$d_g = \begin{cases} \operatorname{argmax}|C_r(n)| & \operatorname{argmax}|C_r(n)| \le N/2 \\ \operatorname{argmax}|C_r(n)| - N & \operatorname{argmax}|C_r(n)| > N/2 \end{cases} \quad \text{(Formula 3)}$$

When the maximum value is found from the weighted cross-correlation function, the maximum value $d_g$ may be calculated by using Formula 4 below:

$$d_g = \begin{cases} \operatorname{argmax}(C_r(n)) & \operatorname{argmax}(C_r(n)) \le N/2 \\ \operatorname{argmax}(C_r(n)) - N & \operatorname{argmax}(C_r(n)) > N/2 \end{cases} \quad \text{(Formula 4)}$$

where, $|C_r(n)|$ indicates the amplitude of $C_r(n)$, arg max$|(C_r(n))|$ indicates an index value corresponding to the maximum absolute value of the cross-correlation function, and N indicates the length of time-frequency transform.

In the embodiment of the present invention, whether a sound signal is a sound signal in a crosstalk is detected; when the sound signal is detected to be a sound signal in the crosstalk, an interchannel delay corresponding to the sound signal is set to a fixed value. Compared with the prior art in which a uniform method for estimating an interchannel delay is used without detecting whether the sound signal is a sound signal in a crosstalk, while, in the embodiment of the present invention, the interchannel delay corresponding to the sound signal which is detected to be a sound signal in the crosstalk is set to be a fixed value, so as to avoid wrong estimation of the interchannel delay causing the instability of a sound field, thereby realizing a stable sound field in the crosstalk.

In addition, in the embodiment of the present invention, a threshold for the number of times when the sound signal is a sound signal in a crosstalk is set; an interchannel delay corresponding to the last frame of the sound signal in the crosstalk in the count is set to a fixed value only when the times threshold is reached, which avoids a case that a sound signal that is not in a crosstalk is processed as a sound signal in a crosstalk due to an error which is caused by a single detection, thereby ensuring that whether a sound signal is a sound signal in a crosstalk can be detected accurately.

Embodiment 3

Figure 4:
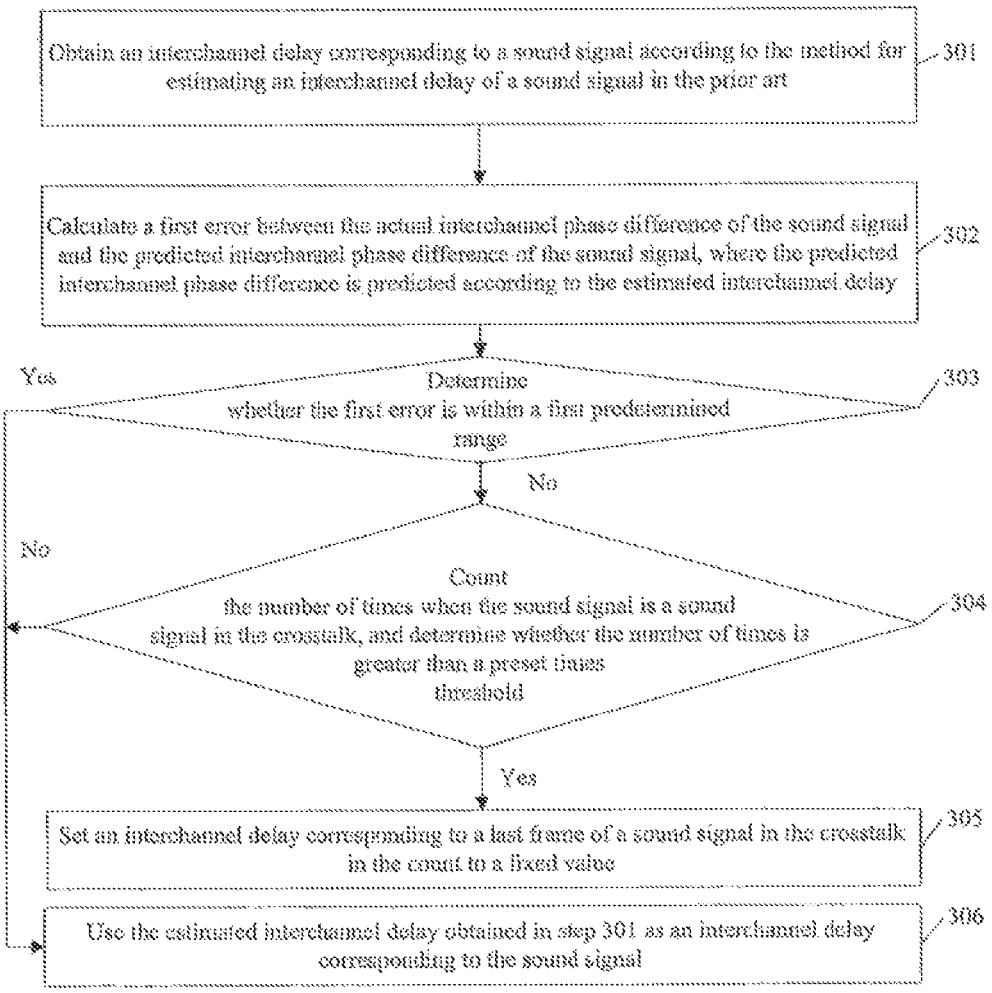
FIG. 4 is a flowchart of a method for estimating an interchannel delay of a sound signal according to a third embodiment of the present invention.

The embodiment of the present invention provides a method for estimating an interchannel delay of a sound signal. When an error between an actual interchannel phase difference and a predicted interchannel phase difference is calculated, the predicted interchannel phase difference may be predicted according to at least one of an estimated interchannel delay and a fixed interchannel delay. In the embodiment of the present invention, the method for estimating an interchannel delay of a sound signal is described in detail based on an assumption that a predicted interchannel phase difference is predicted according to an estimated interchannel delay. As shown in FIG. 4, the method includes the following:

301. Obtain an estimated interchannel delay corresponding to a sound signal according to the method for estimating an interchannel delay of a sound signal in the prior art.

For details about how to obtain an estimated interchannel delay corresponding to a sound signal according to the method for estimating an interchannel delay of a sound signal in the prior art, reference may be made to step 205 in Embodiment 2, and details are not repeated herein.

302. Calculate a first error between the actual interchannel phase difference of the sound signal and the predicted interchannel phase difference of the sound signal, where the predicted interchannel phase difference is predicted according to the estimated interchannel delay.

The first error is obtained by calculating an error between the actual interchannel phase difference of the sound signal and the predicted interchannel phase difference of the sound signal when the predicted interchannel phase difference is predicted according to the estimated interchannel delay of the sound signal. The calculating a first error between the actual interchannel phase difference of the sound signal and the predicted interchannel phase difference of the sound signal that is predicted according to the estimated interchannel delay may include:

calculating an actual interchannel phase difference IPD(k) of the sound signal of each frequency in a frequency band, where the actual interchannel phase difference may be calculated by using Formula 5 below:

$$\mathrm{IPD}(k)=\angle X_1(k)*X_2*(k)\ 0<<\mathrm{Max} \qquad \text{(Formula 5)}$$

where, $X_2*(k)$ indicates the conjugate function of $X_2(k)$, $X_1(k)$ and $X_2(k)$ indicate time-frequency transform of a left channel signal and a right channel signal, respectively, and k indicates the value of a frequency, whose range is [1, Max], where Max indicates the maximum frequency of a frequency band;

calculating a predicted interchannel phase difference IPD'(k) of the sound signal of each frequency in a low frequency band, where the predicted interchannel phase difference may be calculated by using Formula 6 below:

$$IPD'(k)=\frac{-2\pi d_g' * k}{N}\quad 0<k<\mathrm{Max} \qquad \text{(Formula 6)}$$

calculating a first error between the actual interchannel phase difference IPD'(k) and the predicted interchannel phase difference IPG'(k), where the first error may be a sum of absolute values of differences between the actual interchannel phase differences and the predicted interchannel phase differences corresponding to frequencies in a frequency band or may be a mean value of absolute values of differences between the actual interchannel phase differences and the predicted interchannel phase differences corresponding to frequencies in a frequency band, which is not specifically limited in the embodiment of the present invention; the error may also be a quadratic sum of differences between the actual interchannel phase differences and the predicted interchannel phase differences corresponding to frequencies in a frequency band or may be a mean value of squares of differences between the actual interchannel phase differences and the predicted interchannel phase differences corresponding to frequencies in a frequency band.

For example, if the sum of absolute values of differences between the actual interchannel phase differences and the predicted interchannel phase differences corresponding to frequencies in a frequency band is used as the first error, the sum of absolute values of the differences between IPD(k) and IPD'(k) within the range of [1, Max] may be calculated by using Formula 7 below:

$$\sum_{k=1}^{Max-1}|IPD(k)-IPD'(k)| \qquad \text{(Formula 7)}$$

For example, if the mean value of absolute values of differences between the actual interchannel phase differences and the predicted interchannel phase differences corresponding to frequencies in a frequency band is used as the first error, the mean value of absolute values of the differences between IPD(k) and IPD' (k) within the range of [1, Max] may be calculated by using Formula 8 below:

$$\frac{1}{\mathrm{Max}}\sum_{k=1}^{Max-1}|IPD(k)-IPD'(k)| \qquad \text{(Formula 8)}$$

For example, if the quadratic sum of differences between the actual interchannel phase differences and the predicted interchannel phase differences corresponding to frequencies in a frequency band is used as the first error, the quadratic sum of the differences between IPD(k) and IPD'(k) within the range of [1, Max] may be calculated by using Formula 9 below:

$$\sum_{k=1}^{Max-1}(IPD(k)-IPD'(k))^2 \qquad \text{(Formula 9)}$$

For example, if the mean value of squares of differences between the actual interchannel phase differences and the predicted interchannel phase differences corresponding to frequencies in a frequency band is used as the first error, the mean value of squares of the differences between IPD(k) and IPD'(k) within the range of [1, Max] may be calculated by using Formula 10 below:

$$\frac{1}{\text{Max}}\sum_{k=1}^{Max-1}(IPD(k)-IPD'(k))^2 \quad \text{(Formula 10)}$$

303. Determine whether the first error is within a first predetermined range; if the first error is beyond the first predetermined range, it indicates that the sound signal detected is a sound signal in a crosstalk, execute step 304; if the first error is within the first predetermined range, it indicates that the detected sound signal is a sound signal that is not in the crosstalk, execute step 306.

The first predetermined range is an empirical range and is set according to an interchannel delay of a sound signal that is not in the crosstalk. When the first error is within the first predetermined range, it indicates that the sound signal detected is a sound signal that is not in the crosstalk, that is, a sound signal corresponding to a single sound generator; when the first error is beyond the first predetermined range, it indicates that the sound signal detected is a sound signal in the crosstalk. The first predetermined range may be a fixed range set by a user or may be a range of an interchannel delay of a sound signal that is not in a crosstalk and is counted in a certain period of time, which is not specifically limited in the embodiment of the present invention.

304. Count the number of times when the sound signal is a sound signal in the crosstalk, and determine whether the number of times is greater than a preset times threshold; if the number of times is greater than the preset times threshold, it indicates that the current speaking scenario is really a crosstalk and that the received sound signal is really a sound signal in the crosstalk, execute step 305; if the number of times is smaller than or equal to the preset times threshold, it indicates that the current speaking scenario is not a crosstalk and that the received sound signal is not a sound signal in the crosstalk, execute step 306.

The preset times threshold is an empirical value and may be set by a user according to a specific requirement, which is not specifically limited in the embodiment of the present invention. For example, the times threshold may be set to three.

305. Set an interchannel delay corresponding to a last frame of a sound signal in the crosstalk in the count to a fixed value.

The fixed value is an empirical value, and may be set by a user according to the specific implementation, which is not specifically limited in the embodiment of the present invention. For example, the fixed value may be set to "0". The interchannel delay corresponding to the last frame of the sound signal in the crosstalk in the count is set to a fixed value, to maintain the stability of the sound intensity.

306. Use the estimated interchannel delay obtained in step 301 as an interchannel delay corresponding to the sound signal.

In the embodiment of the present invention, whether a sound signal is a sound signal in a crosstalk is detected; when the sound signal is detected to be a sound signal in the crosstalk, an interchannel delay corresponding to the sound signal is set to a fixed value. Compared with the prior art in which a uniform method for estimating an interchannel delay is used without detecting whether the sound signal is a sound signal in a crosstalk, while, in the embodiment of the present invention, the interchannel delay corresponding to the sound signal which is detected to be a sound signal in the crosstalk is set to be a fixed value, so as to avoid wrong estimation of the interchannel delay causing the instability of a sound field, thereby realizing a stable sound field in the crosstalk.

In addition, in the embodiment of the present invention, a threshold for the number of times when the sound signal is a sound signal in a crosstalk is set; an interchannel delay corresponding to the last frame of the sound signal in the crosstalk in the count is set to a fixed value only when the times threshold is reached, which avoids a case that a sound signal that is not in a crosstalk is processed as a sound signal in a crosstalk due to an error which is caused by a single detection, thereby ensuring that whether a sound signal is a sound signal in a crosstalk can be detected accurately.

Embodiment 4

Figure 5:
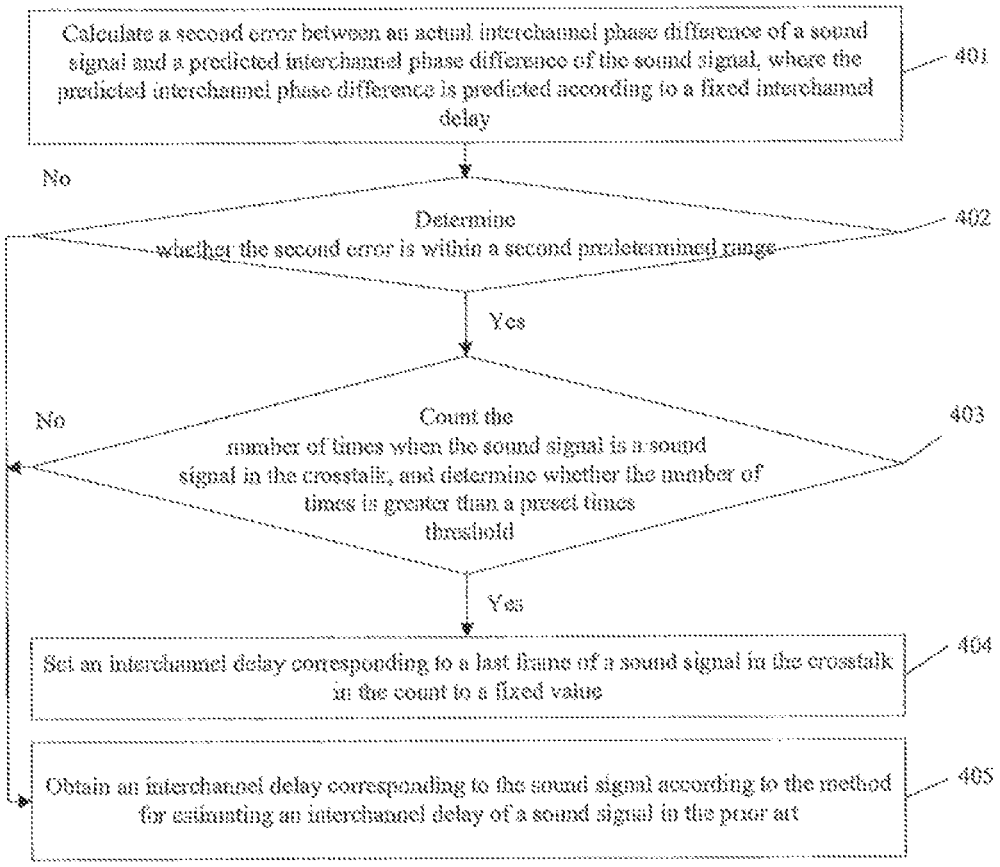
FIG. 5 is a flowchart of a method for estimating an interchannel delay of a sound signal according to a fourth embodiment of the present invention.

The embodiment of the present invention provides a method for estimating an interchannel delay of a sound signal. In the embodiment of the present invention, the method for estimating an interchannel delay of a sound signal is described in detail based on an assumption that a predicted interchannel phase difference is predicted according to a fixed interchannel delay. As shown in FIG. 5, the method includes the following:

401. Calculate a second error between an actual interchannel phase difference of a sound signal and a predicted interchannel phase difference of the sound signal, where the predicted interchannel phase difference is predicted according to a fixed interchannel delay.

The second error is obtained by calculating an error between the actual interchannel phase difference of the sound signal and the predicted interchannel phase difference of the sound signal when the predicted interchannel phase difference is predicted according to the fixed interchannel delay of the sound signal. The calculating a second error between the actual interchannel phase difference of the sound signal and the predicted interchannel phase difference of the sound signal, where the predicted interchannel phase difference is predicted according to the fixed interchannel delay may include:

calculating an actual interchannel phase difference IPD(k) of the sound signal of each frequency in a low frequency band, where the actual interchannel phase difference may be calculated by using Formula 5 in the third embodiment, and is not repeated herein;

calculating a predicted interchannel phase difference IPD'(k) of the sound signal of each frequency in a low frequency band, where the predicted interchannel phase difference may be calculated by using Formula 6 in the third embodiment, but the predicted interchannel phase difference IPD'(k) is predicted according to the fixed interchannel delay, and when the fixed interchannel delay is 0, the predicted interchannel phase difference IPD'(k) is equal to 0; and calculating the second error when the fixed interchannel delay is set to 0, where the second error may be a sum of absolute values of differences between the actual interchannel phase differences and the predicted interchannel phase differences corresponding to frequencies in a frequency band or be a mean value of absolute values of differences between the actual interchannel phase differences and the predicted interchannel phase differences corresponding to frequencies in a frequency band, which is not specifically limited in the embodiment of the present invention; the error may also be a quadratic sum of differences between the actual interchannel phase differences and the predicted interchannel phase differences corresponding to frequencies in a frequency band or be a mean value of squares of differences between the actual interchannel phase differences and the predicted interchannel phase differences corresponding to frequencies in a frequency band.

For example, if the sum of absolute values of differences between the actual interchannel phase differences and the predicted interchannel phase differences corresponding to frequencies in a frequency band is used as the second error, the sum of absolute values of the differences between IPD(k) and IPD'(k) within the range of [1, Max] may be calculated by using Formula 11 below:

$$\sum_{k=1}^{Max-1} |IPD(k)| \quad \text{(Formula 11)}$$

For example, if the mean value of absolute values of differences between the actual interchannel phase differences and the predicted interchannel phase differences corresponding to frequencies in a frequency band is used as the second error, the mean value of absolute values of the differences between IPD(k) and IPD'(k) within the range of [1, Max] may be calculated by using Formula 12 below:

$$\frac{1}{\text{Max}} \sum_{k=1}^{Max-1} |IPD(k)| \quad \text{(Formula 12)}$$

For example, if the quadratic sum of differences between the actual interchannel phase differences and the predicted interchannel phase differences corresponding to frequencies in a frequency band is used as the second error, the quadratic sum of the differences between IPD(k) and IPD'(k) within the range of [1, Max] may be calculated by using Formula 13 below:

$$\sum_{k=1}^{Max-1} (IPD(k))^2 \quad \text{(Formula 13)}$$

For example, if the mean value of squares of differences between the actual interchannel phase differences and the predicted interchannel phase differences corresponding to frequencies in a frequency band is used as the second error, the mean value of squares of the differences between IPD(k) and IPD'(k) within the range of [1, Max] may be calculated by using Formula 14 below:

$$\frac{1}{\text{Max}} \sum_{k=1}^{Max-1} (IPD(k))^2 \quad \text{(Formula 14)}$$

402. Determine whether the second error is within a second predetermined range; if the second error is within the second predetermined range, it indicates that the detected sound signal is a sound signal in a crosstalk, execute step 403; if the second error is beyond the second predetermined range, it indicates that the detected sound signal is not a sound signal in a crosstalk, execute step 405.

The second predetermined range is an empirical range and is set according to the interchannel delay of a sound signal in a crosstalk. When the second error is within the second predetermined range, it indicates that the detected sound signal is a sound signal in the crosstalk; when the second error is beyond the second predetermined range, it indicates that the detected sound signal is not a sound signal in the crosstalk, that is, a sound signal corresponding to a single sound generator. The second predetermined range may be a fixed range set by a user or may be a range of the interchannel delay of a sound signal that is not in the crosstalk and is counted in a certain period of time, which is not specifically limited in the embodiment of the present invention.

403. Count the number of times when the sound signal is a sound signal in the crosstalk, and determine whether the number of times is greater than a preset times threshold; if the number of times is greater than the preset times threshold, it indicates that the current speaking scenario is really a crosstalk and that the received sound signal is really a sound signal in the crosstalk, execute step 404; if the number of times is smaller than or equal to the preset times threshold, it indicates that the current speaking scenario is not a crosstalk and that the received sound signal is not a sound signal in the crosstalk, execute step 405.

The preset times threshold is an empirical value and may be set by a user according to a specific requirement, which is not specifically limited in the embodiment of the present invention. For example, the times threshold may be set to three.

404. Set an interchannel delay corresponding to a last frame of a sound signal in the crosstalk in the count to a fixed value.

The fixed value is an empirical value, and may be set by a user according to the specific implementation, which is not specifically limited in the embodiment of the present invention. For example, the fixed value may be set to "0". The interchannel delay corresponding to the last frame of the sound signal in the crosstalk in the count is set to a fixed value to maintain the stability of the sound intensity.

405. Obtain an estimated interchannel delay corresponding to the sound signal according to the method for estimating an interchannel delay of a sound signal in the prior art.

For details about how to obtain an estimated interchannel delay corresponding to a sound signal according to the method for estimating an interchannel delay of a sound signal in the prior art, reference may be made to step 205 in the second embodiment, which is not repeated herein.

In the embodiment of the present invention, whether a sound signal is a sound signal in a crosstalk is detected; when the sound signal is detected to be a sound signal in the crosstalk, an interchannel delay corresponding to the sound signal is set to a fixed value. Compared with the prior art in which a uniform method for estimating an interchannel delay is used without detecting whether the sound signal is a sound signal in a crosstalk, while, in the embodiment of the present invention, the interchannel delay corresponding to the sound signal which is detected to be a sound signal in the crosstalk is set to be a fixed value, so as to avoid wrong estimation of the interchannel delay causing the instability of a sound field, thereby realizing a stable sound field in the crosstalk.

In addition, in the embodiment of the present invention, a threshold for the number of times when the sound signal is a sound signal in a crosstalk is set; an interchannel delay corresponding to the last frame of the sound signal in the crosstalk in the count is set to a fixed value only when the times threshold is reached, which avoids a case that a sound signal that is not in a crosstalk is processed as a sound signal in a crosstalk due to an error which is caused by a single detection, thereby ensuring that whether a sound signal is a sound signal in a crosstalk can be detected accurately.

Embodiment 5

Figure 6:
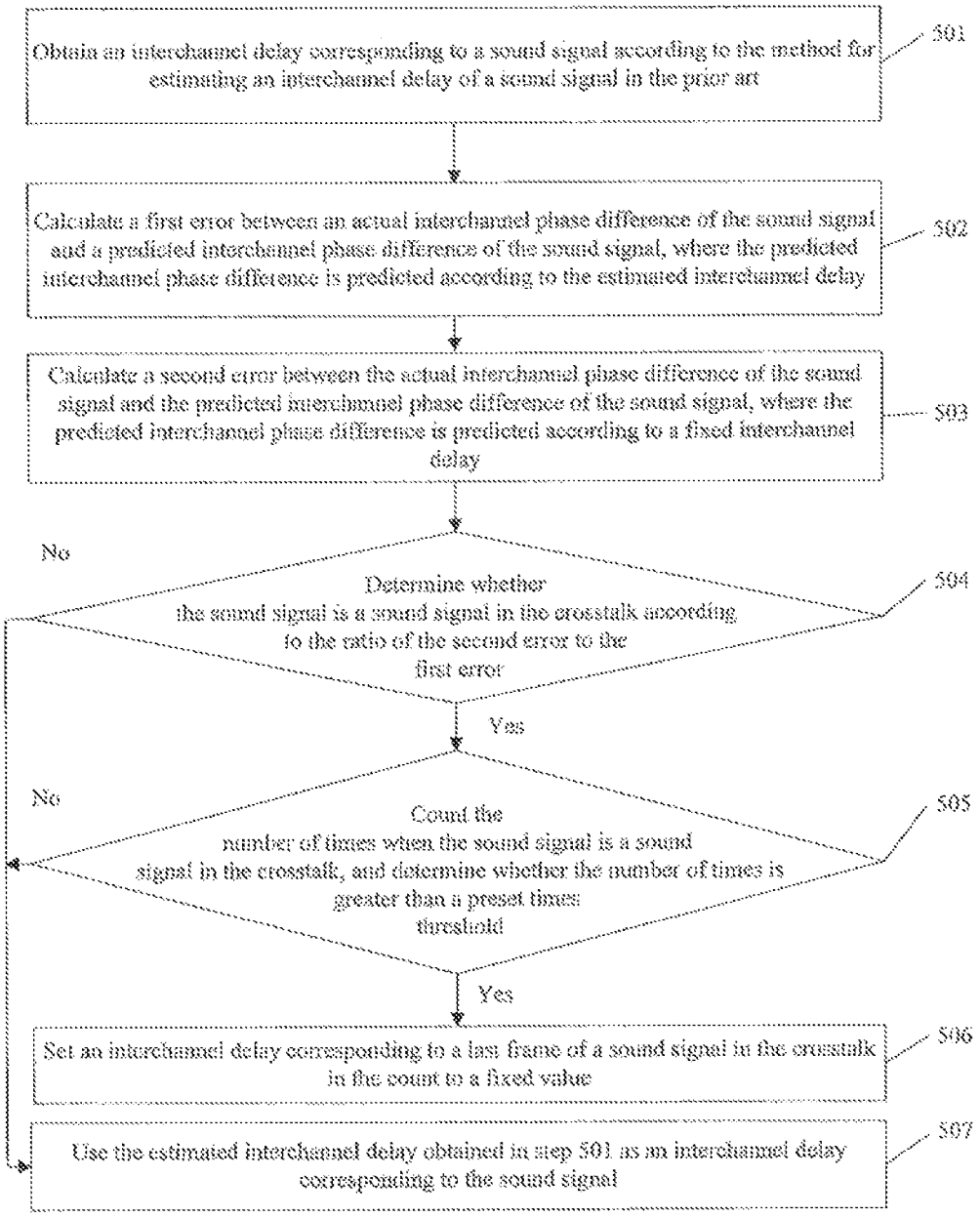
FIG. 6 is a flowchart of a method for estimating an interchannel delay of a sound signal according to a fifth embodiment of the present invention.

The embodiment of the present invention provides a method for estimating an interchannel delay of a sound signal. In the embodiment of the present invention, the method for estimating an interchannel delay of a sound signal is described in detail based on an assumption that a predicted interchannel phase difference is predicted according to an estimated interchannel delay and a fixed interchannel delay. As shown in FIG. 6, the method includes the following:

501. Obtain an estimated interchannel delay corresponding to a sound signal according to the method for estimating an interchannel delay of a sound signal in the prior art.

For details about how to obtain an estimated interchannel delay corresponding to a sound signal according to the method for estimating an interchannel delay of a sound signal in the prior art, reference may be made to step 205 in the second embodiment, which is not repeated herein.

502. Calculate a first error between an actual interchannel phase difference of the sound signal and a predicted interchannel phase difference of the sound signal, where the predicted interchannel phase difference is predicted according to the estimated interchannel delay.

The first error is obtained by calculating an error between the actual interchannel phase difference of the sound signal and the predicted interchannel phase difference of the sound signal when the predicted interchannel phase difference is predicted according to the estimated interchannel delay of the sound signal. For details about how to calculate a first error between the actual interchannel phase difference of the sound signal and the predicted interchannel phase difference of the sound signal, where the predicted interchannel phase difference is predicted according to the estimated interchannel delay, reference may be made to step 302 in the third embodiment, which is not repeated herein.

503. Calculate a second error between the actual interchannel phase difference of the sound signal and the predicted interchannel phase difference of the sound signal, where the predicted interchannel phase difference is predicted according to a fixed interchannel delay.

The second error is obtained by calculating an error between the actual interchannel phase difference of the sound signal and the predicted interchannel phase difference of the sound signal when the predicted interchannel phase difference is predicted according to the fixed interchannel delay of the sound signal. For details about how to calculate a second error between the actual interchannel phase difference of the sound signal and the predicted interchannel phase difference of the sound signal, where the predicted interchannel phase difference is predicted according to the fixed interchannel delay, reference may be made to step 401 in the fourth embodiment, which is not repeated herein.

504. Determine whether the sound signal is a sound signal in a crosstalk according to the ratio of the second error to the first error; if the sound signal is a sound signal in the crosstalk, execute step 505; if the sound signal is not a sound signal in the crosstalk, execute step 507.

The determining whether the sound signal is a sound signal in a crosstalk according to the ratio of the second error to the first error includes: determining whether the ratio is smaller than a first threshold; if the ratio is smaller than the first threshold, determining that the sound signal is a sound signal in the crosstalk, and executing step 504; if the ratio is greater than or equal to the first threshold, determining that the sound signal is not a sound signal in the crosstalk, and executing step 507.

505. Count the number of times when the sound signal is a sound signal in the crosstalk, and determine whether the number of times is greater than a preset times threshold; if the number of times is greater than the preset times threshold, it indicates that the current speaking scenario is really a crosstalk and that the received sound signal is really a sound signal in the crosstalk, execute step 506; if the number of times is smaller than or equal to the preset times threshold, it indicates that the current speaking scenario is not a crosstalk and that the received sound signal is not a sound signal in the crosstalk, execute step 507.

The preset times threshold is an empirical value and may be set by a user according to a specific requirement, which is not specifically limited in the embodiment of the present invention. For example, the times threshold may be set to three.

506. Set an interchannel delay corresponding to a last frame of a sound signal in the crosstalk in the count to a fixed value.

The fixed value is an empirical value, and may be set by a user according to the specific implementation, which is not specifically limited in the embodiment of the present invention. For example, the fixed value may be set to "0". The interchannel delay corresponding to the last frame of the sound signal in the crosstalk in the count is set to a fixed value to maintain the stability of the sound intensity.

507. Use the estimated interchannel delay obtained in step 501 as an interchannel delay corresponding to the sound signal.

It should be noted that the step of calculating the first error and the step of calculating the second error are executed in any sequence. In the embodiment of the present invention, for the convenience of description, the step of calculating the first error is executed in step 502, while the step of calculating the second error is executed in step 503. In the specific implementation of the embodiment of the present invention, the step of calculating the second error may also be executed in step 502, and the step of calculating the first error may be executed in step 503, which are not specifically limited in the embodiment of the present invention.

In the embodiment of the present invention, whether a sound signal is a sound signal in a crosstalk is detected; when the sound signal is detected to be a sound signal in the crosstalk, an interchannel delay corresponding to the sound signal is set to a fixed value. Compared with the prior art in which a uniform method for estimating an interchannel delay is used without detecting whether the sound signal is a sound signal in a crosstalk, while, in the embodiment of the present invention, the interchannel delay corresponding to the sound signal which is detected to be a sound signal in the crosstalk is set to be a fixed value, so as to avoid wrong estimation of the interchannel delay causing the instability of a sound field, thereby realizing a stable sound field in the crosstalk.

In addition, in the embodiment of the present invention, a threshold for the number of times when the sound signal is a sound signal in a crosstalk is set; an interchannel delay corresponding to the last frame of the sound signal of in the crosstalk in the count is set to a fixed value only when the times threshold is reached, which avoids a case that a sound signal that is not in a crosstalk is processed as a sound signal in a crosstalk due to an error which is caused by a single detection, thereby ensuring that whether a sound signal is a sound signal in a crosstalk can be detected accurately.

Embodiment 6

Figure 7:
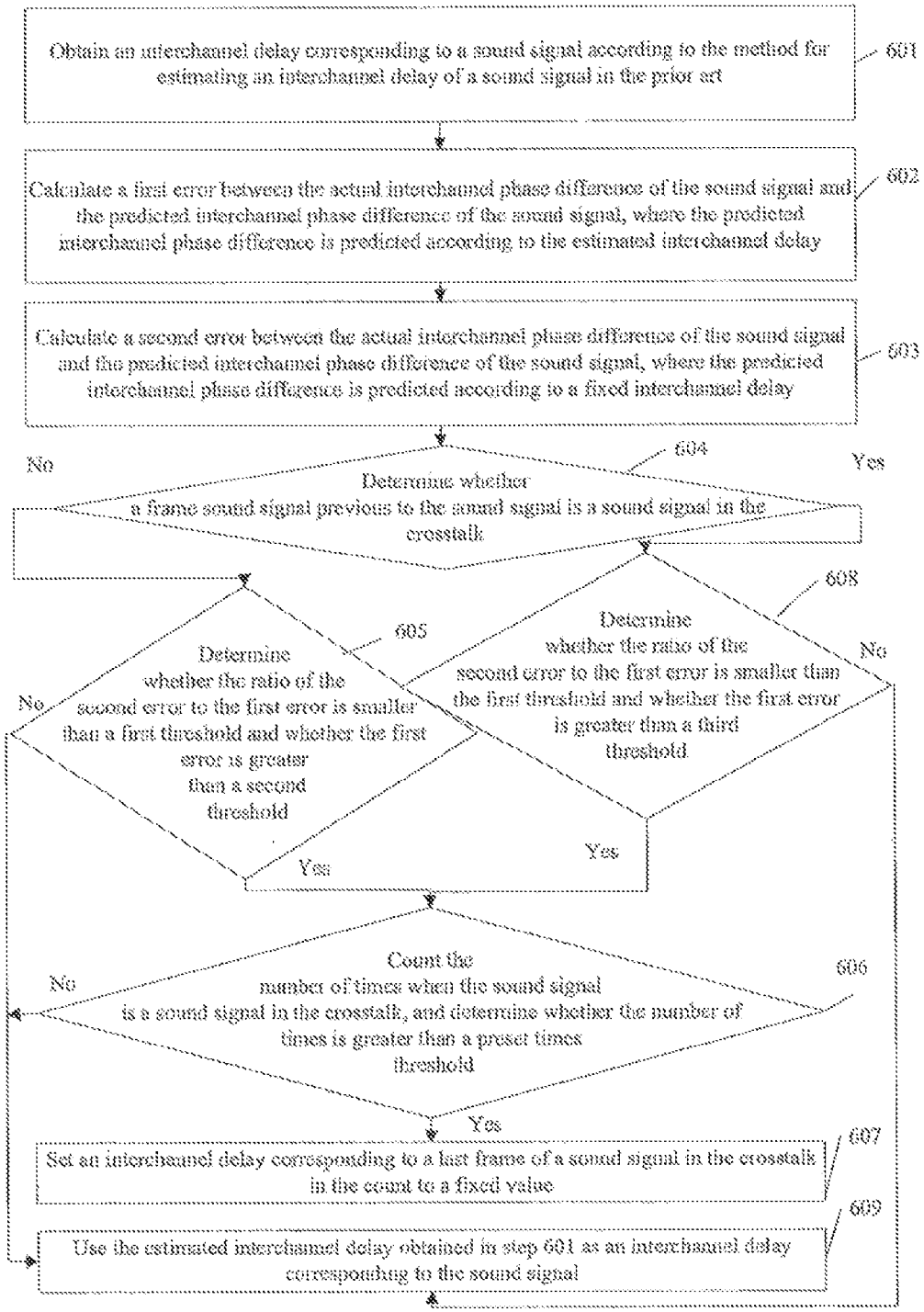
FIG. 7 is a flowchart of a method for estimating an interchannel delay of a sound signal according to a sixth embodiment of the present invention.

The embodiment of the present invention provides a method for estimating an interchannel delay of a sound signal. In the embodiment of the present invention, the method for estimating an interchannel delay of a sound signal is described in detail based on an assumption that whether a sound signal is a sound signal in a crosstalk is determined according to the ratio of a second error to a first error and the first error. As shown in FIG. 7, the method includes the following:

601. Obtain an estimated interchannel delay corresponding to a sound signal according to the method for estimating an interchannel delay of a sound signal in the prior art.

For details about how to obtain an estimated interchannel delay corresponding to a sound signal according to the method for estimating an interchannel delay of a sound signal in the prior art, reference may be made to step 205 in the second embodiment, which is not repeated herein.

602. Calculate a first error between the actual interchannel phase difference of the sound signal and the predicted interchannel phase difference of the sound signal, where the predicted interchannel phase difference is predicted according to the estimated interchannel delay.

The first error is obtained by calculating an error between the actual interchannel phase difference of the sound signal and the predicted interchannel phase difference of the sound signal when the predicted interchannel phase difference is predicted according to the estimated interchannel delay of the sound signal. For details about how to calculate a first error between the actual interchannel phase difference of the sound signal and the predicted interchannel phase difference of the sound signal, where the predicted interchannel phase difference is predicted according to the estimated interchannel delay, reference may be made to step 302 in the third embodiment, which is not repeated herein.

603. Calculate a second error between the actual interchannel phase difference of the sound signal and the predicted interchannel phase difference of the sound signal, where the predicted interchannel phase difference is predicted according to a fixed interchannel delay.

The second error is obtained by calculating an error between the actual interchannel phase difference of the sound signal and the predicted interchannel phase difference of the sound signal when the predicted interchannel phase difference is predicted according to the fixed interchannel delay of the sound signal. For details about how to calculate a second error between the actual interchannel phase difference of the sound signal and the predicted interchannel phase difference of the sound signal, where the predicted interchannel phase difference is predicted according to the fixed interchannel delay, reference may be made to step 401 in the fourth embodiment, which is not repeated herein.

604. Determine whether a frame sound signal previous to the sound signal is a sound signal in the crosstalk; if the frame sound signal previous to the sound signal is not a sound signal in the crosstalk, execute step 605; if the frame sound signal previous to the sound signal is a sound signal in the crosstalk, execute step 608.

605. Determine whether the ratio of the second error to the first error is smaller than a first threshold and whether the first error is greater than a second threshold; if the ratio is smaller than the first threshold and the first error is greater than the second threshold, it indicates that the sound signal is a sound signal in the crosstalk, execute step 606; otherwise, execute step 609.

606. Count the number of times when the sound signal is a sound signal in the crosstalk, and determine whether the number of times is greater than a preset times threshold; if the number of times is greater than the preset times threshold, it indicates that the current speaking scenario is really a crosstalk and that the received sound signal is really a sound signal in the crosstalk, execute step 607; if the number of times is smaller than or equal to the preset times threshold, it indicates that the current speaking scenario is not a crosstalk and that the received sound signal is not a sound signal in the crosstalk, execute step 609.

The preset times threshold is an empirical value and may be set by a user according to a specific requirement, which is not specifically limited in the embodiment of the present invention. For example, the times threshold may be set to three.

607. Set an interchannel delay corresponding to a last frame of a sound signal in the crosstalk in the count to a fixed value. Then, the process of estimating the interchannel delay ends.

The fixed value is an empirical value, and may be set by a user according to the specific implementation, which is not specifically limited in the embodiment of the present invention. For example, the fixed value may be set to "0". The interchannel delay corresponding to the last frame of the sound signal in the crosstalk in the count is set to a fixed value to maintain the stability of the sound intensity.

608. Determine whether the ratio of the second error to the first error is smaller than the first threshold and whether the first error is greater than a third threshold; if the ratio is smaller than the first threshold and the first error is greater than the third threshold, execute step 606; otherwise, execute step 609.

609. Use the estimated interchannel delay obtained in step 601 as an interchannel delay corresponding to the sound signal. Then, the process of estimating the interchannel delay ends.

It should be noted that the step of calculating the first error and the step of calculating the second error are executed in any sequence. In the embodiment of the present invention, for the convenience of description, the step of calculating the first error is executed in step 602, while the step of calculating the second error is executed in step 603. In the specific implementation of the embodiment of the present invention, the step of calculating the second error may also be executed in step 602, and the step of calculating the first error may be executed in step 603, which are not specifically limited in the embodiment of the present invention.

In the embodiment of the present invention, whether a sound signal is a sound signal in a crosstalk is detected; when the sound signal is detected to be a sound signal in the crosstalk, an interchannel delay corresponding to the sound signal is set to a fixed value. Compared with the prior art in which a uniform method for estimating an interchannel delay is used without detecting whether the sound signal is a sound signal in a crosstalk, while, in the embodiment of the present invention, the interchannel delay corresponding to the sound signal which is detected to be a sound signal in the crosstalk is set to be a fixed value, so as to avoid wrong estimation of the interchannel delay causing the instability of a sound field, thereby realizing a stable sound field in the crosstalk.

In addition, in the embodiment of the present invention, a threshold for the number of times when the sound signal is a sound signal in a crosstalk is set; an interchannel delay corresponding to the last frame of the sound signal in the crosstalk in the count is set to a fixed value only when the times threshold is reached, which avoids a case that a sound signal that is not in a crosstalk is processed as a sound signal in a crosstalk due to an error which is caused by a single detection, thereby ensuring that whether a sound signal is a sound signal in a crosstalk can be detected accurately.

Further, before a current sound signal is detected, whether a frame sound signal previous to the current sound signal is a sound signal in the crosstalk is determined; according to the determining result, a second threshold and a third threshold are set for detecting whether the current sound signal is a sound signal in the crosstalk, which further ensures the accuracy in detecting whether the current sound signal is a sound signal in the crosstalk, thereby further enhancing the stability of the sound field.

Embodiment 7

Figure 8:
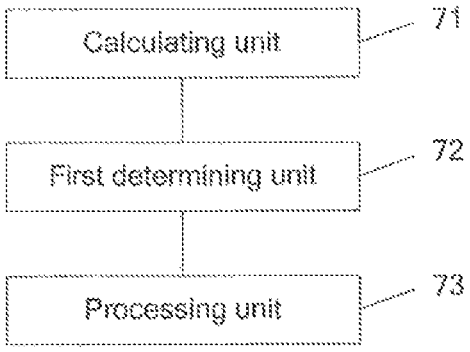
FIG. 8 is a block diagram of an apparatus for estimating an interchannel delay of a sound signal according to a seventh embodiment of the present invention.

The embodiment of the present invention provides an apparatus for estimating an interchannel delay of a sound signal. As shown in FIG. 8, the apparatus includes a calculating unit 71, a first determining unit 72, and a processing unit 73.

The calculating unit 71 is configured to calculate an error between an actual interchannel phase difference and a predicted interchannel phase difference of a sound signal, where the predicted interchannel phase difference is predicted according to a predetermined interchannel delay of the sound signal. The predetermined interchannel delay includes an estimated interchannel delay or a fixed interchannel delay, where the estimated interchannel delay is a delay estimated by using an interchannel correlation.

The first determining unit 72 is configured to determine whether the sound signal is a sound signal in a crosstalk according to the error calculated by the calculating unit 71.

The processing unit 73 is configured to: when the first determining unit 72 determines that the sound signal is a sound signal in the crosstalk, set an interchannel delay corresponding to the sound signal to a fixed value. The fixed value is an empirical value, and may be set by a user according to the specific implementation, which is not specifically limited in the embodiment of the present invention. For example, the fixed value may be set to "0". The interchannel delay corresponding to the sound signal is set to a fixed value to maintain the stability of the sound intensity.

Figure 9:
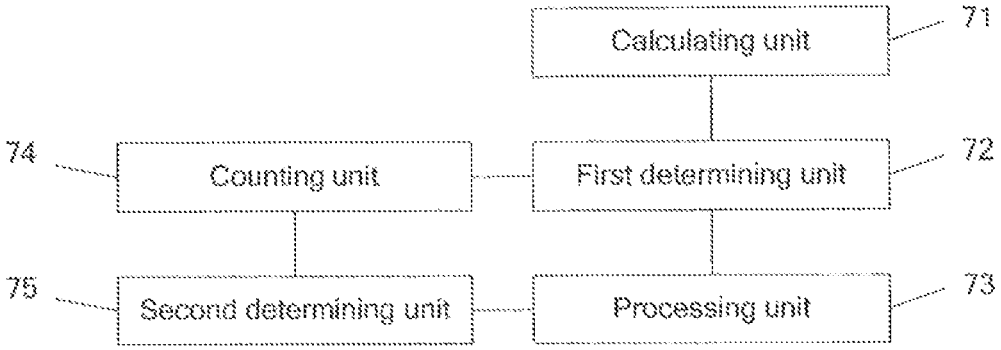
FIG. 9 is another block diagram of an apparatus for estimating an interchannel delay of a sound signal according to a seventh embodiment of the present invention.

Further, as shown in FIG. 9, the apparatus further includes a counting unit 74 and a second determining unit 75.

The counting unit 74 is configured to: after the first determining unit 72 determines that the sound signal is a sound signal in the crosstalk, count the number of times when the sound signal is a sound signal in the crosstalk.

The second determining unit 75 is configured to determine whether the number of times counted by the counting unit 74 is greater than a preset times threshold; when the number of times is greater than the preset times threshold, the processing unit 73 is further configured to set an interchannel delay corresponding to a last frame of a sound signal in the crosstalk in the count to a fixed value.

Figure 10:
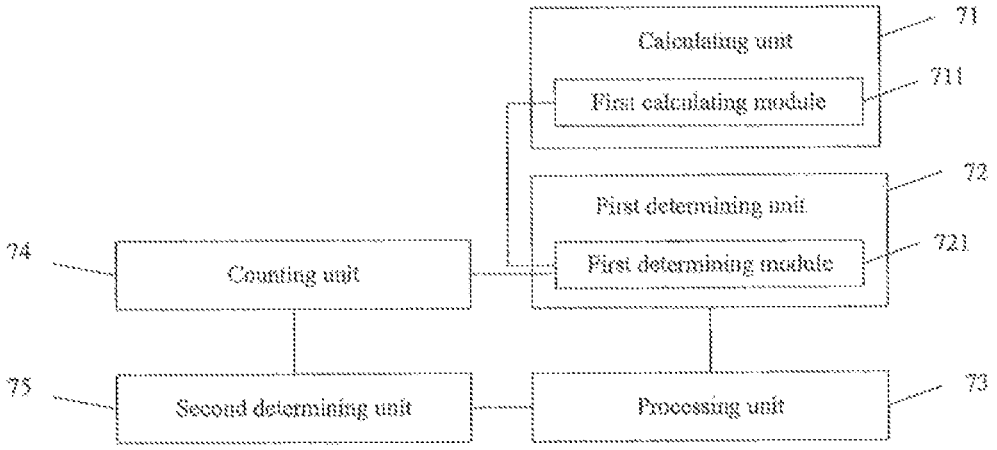
FIG. 10 is another block diagram of an apparatus for estimating an interchannel delay of a sound signal according to a seventh embodiment of the present invention.

Further, when the predetermined interchannel delay is an estimated interchannel delay, as shown in FIG. 10, the calculating unit 71 includes a first calculating module 711; and the first determining unit 72 includes a first determining module 721.

The first calculating module 711 is configured to calculate a first error between an actual interchannel phase difference of a sound signal and a predicted interchannel phase difference of the sound signal, where the predicted interchannel phase difference is predicted according to the estimated interchannel delay.

The first determining module 721 is configured to: determine whether the first error calculated by the first calculating module 711 is within a first predetermined range; when the first error is beyond the first predetermined range, determine that the sound signal is a sound signal in a crosstalk.

Figure 11:
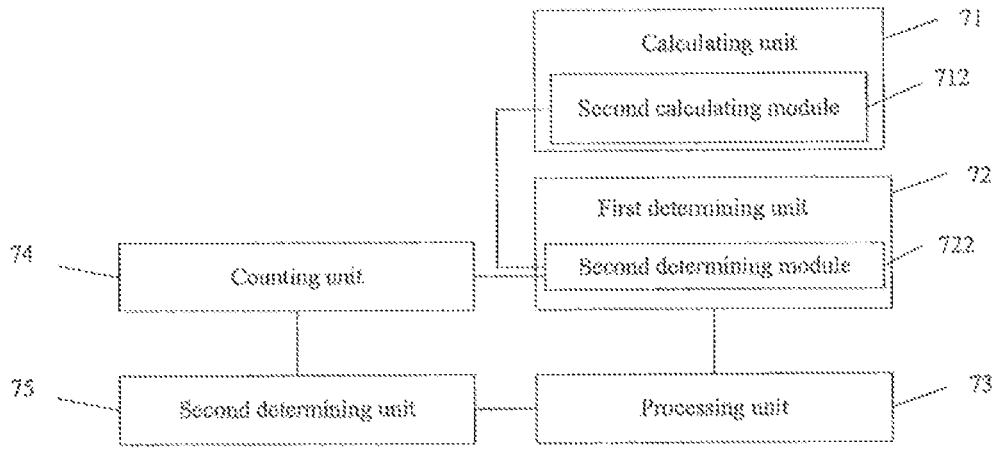
FIG. 11 is another block diagram of an apparatus for estimating an interchannel delay of a sound signal according to a seventh embodiment of the present invention.

Further, when the predetermined interchannel delay is a fixed interchannel delay, as shown in FIG. 11, the calculating unit 71 includes a second calculating module 712; and the first determining unit 72 includes a second determining module 722.

The second calculating module 712 is configured to calculate a second error between an actual interchannel phase difference of a sound signal and a predicted interchannel phase difference of the sound signal, where the predicted interchannel phase difference is predicted according to the fixed interchannel delay.

The second determining module 722 is configured to: determine whether the second error calculated by the second calculating module 712 is within a second predetermined range; when the second error is within the second predetermined range, determine that the sound signal is a sound signal in a crosstalk.

Figure 12:
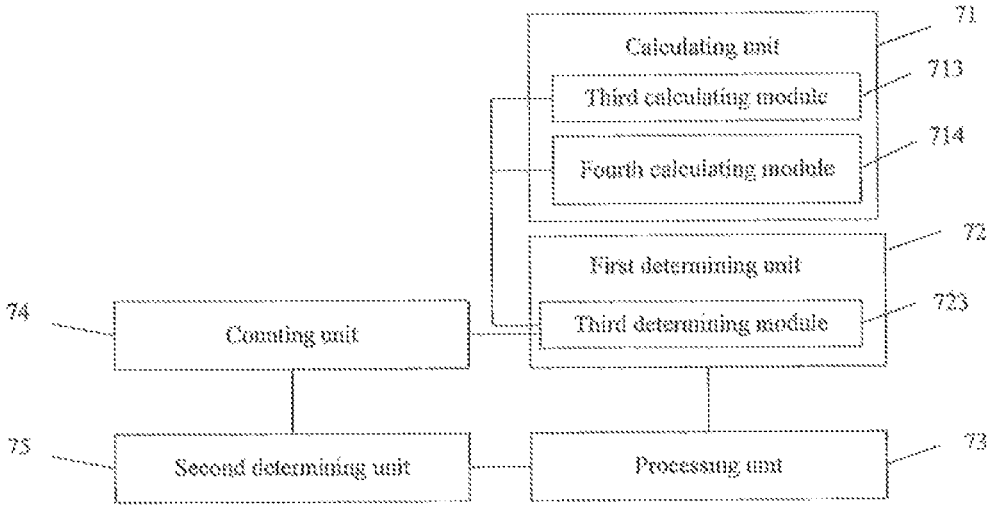
FIG. 12 is another block diagram of an apparatus for estimating an interchannel delay of a sound signal according to a seventh embodiment of the present invention.

Further, when the predetermined interchannel delay is an estimated interchannel delay and a fixed interchannel delay, as shown in FIG. 12, the calculating unit 71 includes a third calculating module 713 and a fourth calculating module 714; and the first determining unit 72 includes a third determining module 723.

The third calculating module 713 is configured to calculate a first error between an actual interchannel phase difference of a sound signal and a predicted interchannel phase difference of the sound signal, where the predicted interchannel phase difference is predicted according to the estimated interchannel delay.

The fourth calculating module 714 is configured to calculate a second error between the actual interchannel phase difference of the sound signal and the predicted interchannel phase difference of the sound signal, where the predicted interchannel phase difference is predicted according to the fixed interchannel delay.

The third determining module 723 is configured to determine that the sound signal is a sound signal in a crosstalk according to the ratio of the second error calculated by the fourth calculating module 714 to the first error calculated by the third calculating module 713. The determining that the sound signal is a sound signal in a crosstalk by the third determining module 723 according to the ratio of the second error calculated by the fourth calculating module 714 to the first error calculated by the third calculating module 713 may include: determining whether the ratio is smaller than a first threshold; when the ratio is smaller than the first threshold, determining that the sound signal is a sound signal in the crosstalk.

Figure 13:
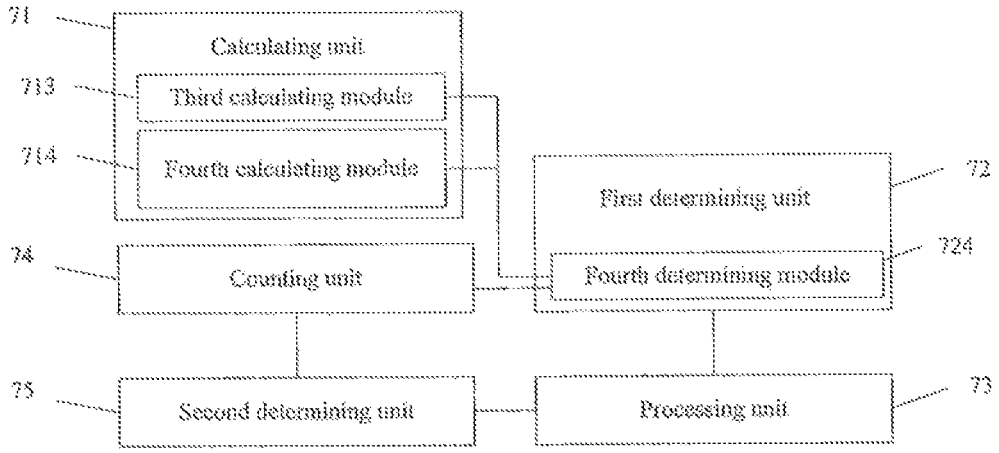
FIG. 13 is another block diagram of an apparatus for estimating an interchannel delay of a sound signal according to a seventh embodiment of the present invention.

Further, when the predetermined interchannel delay is an estimated interchannel delay and a fixed interchannel delay, as shown in FIG. 13, the first determining unit 72 further includes a fourth determining module 724.

The fourth determining module 724 is configured to determine whether the sound signal is a sound signal in a crosstalk according to the ratio of the second error calculated by the fourth calculating module 714 to the first error calculated by the third calculating module 713 and the first error. The determining whether the sound signal is a sound signal in a crosstalk by the fourth determining module 724 according to the ratio of the second error calculated by the fourth calculating module to the first error calculated by the third calculating module 713 and the first error may include: determining whether a frame sound signal previous to the sound signal is a sound signal in the crosstalk; when the frame sound signal previous to the sound signal is not a sound signal in the crosstalk, determining whether the ratio of the second error to the first error is smaller than a first threshold and whether the first error is greater than a second threshold; when the ratio is smaller than the first threshold and the first error is greater than the second threshold, determining that the sound signal is a sound signal in the crosstalk.

When the frame sound signal previous to the sound signal is a sound signal in the crosstalk, the fourth determining module 724 is further configured to: determine whether the ratio of the second error to the first error is smaller than the first threshold and whether the first error is greater than a third threshold; when the ratio is smaller than the first threshold and the first error is greater than the third threshold, determine that the sound signal is a sound signal in the crosstalk.

Further, it should be noted that for details about the modules of the apparatus, reference may be made to the description in other embodiments, which are not repeated herein.

In the embodiment of the present invention, whether a sound signal is a sound signal in a crosstalk is detected; when the sound signal is detected to be a sound signal in the crosstalk, an interchannel delay corresponding to the sound signal is set to a fixed value. Compared with the prior art in which a uniform method for estimating an interchannel delay is used without detecting whether the sound signal is a sound signal in a crosstalk, while, in the embodiment of the present invention, the interchannel delay corresponding to the sound signal which is detected to be a sound signal in the crosstalk is set to be a fixed value, so as to avoid wrong estimation of the interchannel delay causing the instability of a sound field, thereby realizing a stable sound field in the crosstalk.

In addition, in the embodiment of the present invention, a threshold for the number of times when the sound signal is a sound signal in a crosstalk is set; an interchannel delay corresponding to the last frame of the sound signal in the crosstalk in the count is set to a fixed value only when the times threshold is reached, which avoids a case that a sound signal that is not in a crosstalk is processed as a sound signal in a crosstalk due to an error which is caused by a single detection, thereby ensuring that whether a sound signal is a sound signal in a crosstalk can be detected accurately.

Further, before a current sound signal is detected, whether a frame sound signal previous to the current sound signal is a sound signal in the crosstalk is determined; according to the determining result, a second threshold and a third threshold are set for detecting whether the current sound signal is a sound signal in the crosstalk, which further ensures the accuracy of detecting whether the current sound signal is a sound signal in the crosstalk, thereby further enhancing the stability of the sound field.

Through the foregoing description of the embodiments, persons skilled in the art clearly understand that the present invention may be implemented by software in addition to a necessary universal hardware, and definitely may also be implemented by hardware, but in most circumstances, the former is preferred. Based on such understanding, the technical solutions of the present invention essentially, or the part contributing to the prior art may be implemented in the form of a software product. The computer software product is stored in a readable storage medium, for example, a floppy disk, hard disk, or optical disk of the computer, and includes several instructions for instructing a computer device (which may be a personal computer, a server, a network device, and the like) to perform the methods described in the embodiments of the present invention.

The foregoing description is merely about the specific embodiments of the present invention, but is not intended to limit the protection scope of the present invention. Any variation or replacement readily figured out by persons skilled in the art within the technical scope disclosed in the present invention shall all fall within the protection scope of the present invention. Therefore, the protection scope of the present invention shall be subject to the protection scope of the claims.

What is claimed is:

1. A method for estimating an interchannel delay of a sound signal, the method comprising:

calculating an error between an actual interchannel phase difference and a predicted interchannel phase difference of a sound signal, wherein the predicted interchannel phase difference is predicted according to a predetermined interchannel delay of the sound signal;

determining whether the sound signal is a sound signal in a crosstalk according to whether the error is within a predetermined range or beyond the predetermined range, the predetermined range being set according to an interchannel delay of a sound signal that is not in the crosstalk; and if the sound signal is a sound signal in the crosstalk, setting an interchannel delay corresponding to the sound signal to a fixed value.

2. The method according to claim 1, wherein the predetermined interchannel delay comprises at least one of an estimated interchannel delay and a fixed interchannel delay, wherein the estimated interchannel delay is a delay estimated by using an interchannel correlation.

3. The method according to claim 2, wherein when the predetermined interchannel delay is the estimated interchannel delay, the calculating an error between an actual interchannel phase difference and a predicted interchannel phase difference of a sound signal comprises:

calculating a first error between the actual interchannel phase difference of the sound signal and the predicted interchannel phase difference of the sound signal, where the predicted interchannel phase difference is predicted according to the estimated interchannel delay;

the determining whether the sound signal is a sound signal in the crosstalk according to whether the error is within a predetermined range or beyond the predetermined range comprises: determining whether the first error is within a first predetermined range; and if the first error is beyond the first predetermined range, determining that the sound signal is a sound signal in the crosstalk.

4. The method according to claim 2, wherein when the predetermined interchannel delay is the fixed interchannel delay, the calculating an error between an actual interchannel phase difference and a predicted interchannel phase difference of a sound signal comprises:

calculating a second error between the actual interchannel phase difference of the sound signal and the predicted interchannel phase difference of the sound signal, where the predicted interchannel phase difference is predicted according to the fixed interchannel delay;

the determining whether the sound signal is a sound signal in the crosstalk according to whether the error is within a predetermined range or beyond the predetermined range comprises: determining whether the second error is within a second predetermined range; and if the second error is within the second predetermined range, determining that the sound signal is a sound signal in the crosstalk.

5. The method according to claim 2, wherein when the predetermined interchannel delay is the estimated interchannel delay and a fixed interchannel delay, the calculating an error between an actual interchannel phase difference and a predicted interchannel phase difference of a sound signal comprises:

calculating a first error between the actual interchannel phase difference of the sound signal and the predicted interchannel phase difference of the sound signal, where the predicted interchannel phase difference is predicted according to the estimated interchannel delay;

calculating a second error between the actual interchannel phase difference of the sound signal and the predicted interchannel phase difference of the sound signal, where the predicted interchannel phase difference is predicted according to the fixed interchannel delay;

the determining whether the sound signal is a sound signal in the crosstalk according to whether the error is within a predetermined range or beyond the predetermined range comprises: determining whether the sound signal is a sound signal in the crosstalk according to a ratio of the second error to the first error; or determining whether the sound signal is a sound signal in the crosstalk according to a ratio of the second error to the first error and the first error.

6. The method according to claim 5, wherein the determining whether the sound signal is a sound signal in the crosstalk according to a ratio of the second error to the first error comprises:

determining whether the ratio is smaller than a first threshold; and if the ratio is smaller than the first threshold, determining that the sound signal is a sound signal in the crosstalk.

7. The method according to claim 5, wherein the determining whether the sound signal is a sound signal in the crosstalk according to a ratio of the second error to the first error and the first error comprises:

determining whether a frame sound signal previous to the sound signal is a sound signal in the crosstalk;

if the frame sound signal previous to the sound signal is not a sound signal in the crosstalk, determining whether the ratio of the second error to the first error is smaller than a first threshold and whether the first error is greater than a second threshold; if the ratio is smaller than the first threshold and the first error is greater than the second threshold, determining that the sound signal is a sound signal in the crosstalk;

if a frame sound signal previous to the sound signal is a sound signal in the crosstalk, determining whether the ratio of the second error to the first error is smaller than a first threshold and whether the first error is greater than a third threshold; if the ratio is smaller than the first threshold and the first error is greater than the third threshold, determining that the sound signal is a sound signal in the crosstalk.

8. The method according to claim 1, wherein after the determining that the sound signal is a sound signal in the crosstalk, the method further comprises:

counting the number of times when the sound signal is a sound signal in the crosstalk, and determining whether the number of times is greater than a preset times threshold; and if the number of times is greater than the preset times threshold, the setting an interchannel delay corresponding to the sound signal to a fixed value comprises: setting an interchannel delay corresponding to a last frame of a sound signal in the crosstalk in the count to the fixed value.

9. An apparatus for estimating an interchannel delay of a sound signal, the apparatus comprising:

a calculating unit implemented by a processor, configured to calculate an error between an actual interchannel phase difference and a predicted interchannel phase difference of a sound signal, wherein the predicted interchannel phase difference is predicted according to a predetermined interchannel delay of the sound signal;

a first determining unit implemented by the processor, configured to determine whether the sound signal is a sound signal in a crosstalk according to whether the error calculated by the calculating unit is within a predetermined range or beyond the predetermined range, the predetermined range being set according to an interchannel delay of a sound signal that is not in the crosstalk; and a processing unit implemented by the processor, configured to: when the first determining unit determines that the sound signal is a sound signal in the crosstalk, set an interchannel delay corresponding to the sound signal to a fixed value.

10. The apparatus according to claim 9, wherein the predetermined interchannel delay comprises at least one of an estimated interchannel delay and a fixed interchannel delay, wherein the estimated interchannel delay is a delay estimated by using an interchannel correlation.

11. The apparatus according to claim 9, wherein when the predetermined interchannel delay is an estimated interchannel delay, the calculating unit comprises a first calculating module, configured to calculate a first error between the actual interchannel phase difference of the sound signal and the predicted interchannel phase difference of the sound signal, where the predicted interchannel phase difference is predicted according to the estimated interchannel delay; and the first determining unit comprises a first determining module, configured to determine whether the first error calculated by the first calculating module is within a first predetermined range and when the first error is beyond the first predetermined range, determine that the sound signal is a sound signal in the crosstalk.

12. The apparatus according to claim 9, wherein when the predetermined interchannel delay is a fixed interchannel delay, the calculating unit comprises a second calculating module, configured to calculate a second error between the actual interchannel phase difference of the sound signal and the predicted interchannel phase difference of the sound signal, where the predicted interchannel phase difference is predicted according to the fixed interchannel delay; and the first determining unit comprises a second determining module, configured to determine whether the second error calculated by the second calculating module is within a second predetermined range and, when the second error is within the second predetermined range, determine that the sound signal is a sound signal in the crosstalk.

13. The apparatus according to claim 9, wherein when the predetermined interchannel delay is an estimated interchannel delay and a fixed interchannel delay, the calculating unit comprises:

a third calculating module, configured to calculate a first error between the actual interchannel phase difference of the sound signal and the predicted interchannel phase difference of the sound signal, where the predicted interchannel phase difference is predicted according to the estimated interchannel delay; and a fourth calculating module, configured to calculate a second error between the actual interchannel phase difference of the sound signal and the predicted interchannel phase difference of the sound signal, where the predicted interchannel phase difference is predicted according to the fixed interchannel delay; and the first determining unit comprises a third determining module configured to determine that the sound signal is a sound signal in the crosstalk according to a ratio of the second error to the first error; or the first determining unit further comprises a fourth determining module configured to determine whether the sound signal is a sound signal in the crosstalk according to a ratio of the second error to the first error and the first error.

14. The apparatus according to claim 13, wherein the third determining module is configured to:

determine whether the ratio is smaller than a first threshold; and when the ratio is smaller than the first threshold, determine that the sound signal is a sound signal in the crosstalk.

15. The apparatus according to claim 13, wherein the fourth determining module is configured to:

determine whether a frame sound signal previous to the sound signal is a sound signal in the crosstalk;

when the frame sound signal previous to the sound signal is not a sound signal in the crosstalk, determine whether the ratio of the second error to the first error is smaller than a first threshold and whether the first error is greater than a second threshold;

when the ratio is smaller than the first threshold and the first error is greater than the second threshold, determine that the sound signal is a sound signal in the crosstalk;

when the frame sound signal previous to the sound signal is a sound signal in the crosstalk, determine whether the ratio of the second error to the first error is smaller than a first threshold and whether the first error is greater than a third threshold; and when the ratio is smaller than the first threshold and the first error is greater than the third threshold, determine that the sound signal is a sound signal in the crosstalk.

16. The apparatus according to claim 9, further comprising:

a counting unit implemented by the processor, configured to count the number of times when the sound signal is a sound signal in the crosstalk after the first determining unit determines that the sound signal is a sound signal in the crosstalk; and a second determining unit implemented by the processor, configured to determine whether the number of times counted by the counting unit is greater than a preset times threshold, wherein the processing unit is further configured to set an interchannel delay corresponding to a last frame of a sound signal in the crosstalk in the count to a fixed value when the number of times is greater than the preset times threshold.

17. The method according to claim 1, wherein the predetermined range has units of time.

* * * * *